US006860694B2

(12) United States Patent
Slettedal

(10) Patent No.: US 6,860,694 B2
(45) Date of Patent: Mar. 1, 2005

(54) HORIZONTAL PIPE HANDLING DEVICE

(75) Inventor: Per Slettedal, Øvrebø (NO)

(73) Assignee: Maritime Hydraulics AS, Kristiansand (NO)

( * ) Notice: Subject to any disclaimer, the term of this patent is extended or adjusted under 35 U.S.C. 154(b) by 0 days.

(21) Appl. No.: 10/181,621

(22) PCT Filed: Jan. 12, 2001

(86) PCT No.: PCT/NO01/00009

§ 371 (c)(1),
(2), (4) Date: Nov. 22, 2002

(87) PCT Pub. No.: WO01/51762

PCT Pub. Date: Jul. 19, 2001

(65) Prior Publication Data

US 2003/0170095 A1 Sep. 11, 2003

(30) Foreign Application Priority Data

Jan. 13, 2000 (NO) ..... 20000175
Jan. 19, 2000 (NO) ..... 20000269

(51) Int. Cl.[7] ..... E21B 19/00; B66F 11/00

(52) U.S. Cl. ..... 414/22.51; 414/22.58; 414/22.62; 414/22.68; 414/745.1

(58) Field of Search ..... 414/22.51, 22.59, 414/22.62, 22.58, 745.1, 22.68

(56) References Cited

U.S. PATENT DOCUMENTS 3,651,959 A 3/1972 Castela et al.
3,750,898 A 8/1973 Ancey et al.
3,795,326 A 3/1974 Neilon et al.
3,870,165 A * 3/1975 Besijn ..... 414/22.71
4,380,297 A * 4/1983 Frias ..... 414/22.59
4,439,091 A * 3/1984 Frias ..... 414/22.59
4,993,905 A * 2/1991 Potocnjak ..... 414/277
6,543,551 B1 * 4/2003 Sparks et al. ..... 414/22.58

FOREIGN PATENT DOCUMENTS

DE 3424521 A1 1/1986
DE 3513787 A1 10/1986

* cited by examiner

*Primary Examiner*—Gene O. Crawford
(74) *Attorney, Agent, or Firm*—Knobbe, Martens, Olson & Bear, LLP

(57) ABSTRACT

A device for handling pipes or stands including a transportation carriage for transport of pipes or stands between a pipe storage and a place for use. The carriage includes picking columns, each having a first picking arm arranged to move substantially vertically. The arms are capable of lifting at least one horizontal pipe or stand from the pipe storage. The picking columns are also equipped with a respective second picking arm, capable of motion substantially vertically on the opposite side of the picking column, to hold the pipe or stand between the first and second picking arms. Also described are a storage device and a pipe erecting device to be used together with the transportation carriage.

22 Claims, 15 Drawing Sheets

HORIZONTAL PIPE HANDLING DEVICE

RELATED APPLICATIONS

This application claims the benefit of the International Application PCT/NO01/00009 filed Jan. 12, 2001 in the Norwegian applications 20000175 filed Jan. 13, 2000 and 20000269 filed Jan. 19, 2000.

BACKGROUND OF THE INVENTION

1. Field of the Invention

The present invention regards devices for handling pipes, especially devices for handling pipes in connection with petroleum production.

2. Description of the Related Art

In petroleum production, a large number of pipes is used for various purposes. When drilling a well, a total of up to several kilometres of drill pipes may be used, each of which pipes is generally approximately 10 m long. Prior to use, these pipes are stored in horizontal stacks on deck. The pipes are connected by threes to form so-called stands. During drilling, the pipes are stored vertically as stands in so-called finger boards on the drill floor, up along the derrick. During drilling, the entire drill string must be withdrawn from the well at certain intervals, so-called tripping, e.g. in order to change the drill bit. With today's technology, the pipes are inserted back into the finger boards in order to be easily accessible for future use.

Up to several kilometres of casing may also used in a well in order to form walls in the wellbore. In the same way, several kilometres of production tubing is used in order to recover oil and/or gas from the well. In addition, several kilometres of other types of piping would generally then be required, for instance injection piping. All these pipes must at some stage be stored on or near the rig.

Traditionally, the movement of pipes between the pipe rack and the drill floor has to a large extent been accomplished through manual work. This task is heavy and entails a great danger to life, health and materials. Great efforts have therefore been made to reduce the element of manual work and transfer this to machines, which are preferably remotely controlled.

One factor is decisive when it comes to the profitability of petroleum production, and that is time. As the equipment used is very expensive, the time it takes from when the equipment is put into service, i.e. the drilling is initiated, until the production starts, will to a large extent be decisive in the cost of the development. It is therefore of great importance to reduce the time consumption during all parts of the development. During the pipe handling processes, it is important to have all the pipes ready when they are to be run into the well, and also to ensure that they can be carried away quickly from the drill floor when they are retrieved from the well.

Furthermore, the fact that standing pipes or stands contribute towards giving the drilling or production installation a high centre of gravity, is increasingly becoming a problem. With the increase in drilling depth over the recent years, the number of pipes has increased considerably. Also, the use of smaller, floating installations such as drill ships has become increasingly common. A high centre of gravity in such installations causes instability. As such, it becomes difficult to satisfy the requirements for stability. This means that other equipment must be moved down, possibly also involving an increase in ballast. This leads to less flexibility in the utilisation of the available space. In the case of vertically stored pipes, the wind catchment area also increases, which in combination with a high centre of gravity may have fatal consequences. Thus it has long been desired to be able to store the pipes horizontally. This has however involved awkward and time consuming pipe handling.

SUMMARY OF THE INVENTION

One object of the invention has been to provide pipe handling equipment that may operate independently and in parallel with any drilling activities that may be in progress in the derrick. This means that the piping goods must be able to be moved between a horizontal position and a vertical position in or by the derrick, and vice versa, while a drilling machine and drill string is in operation in the drilling centre in the derrick. In the case of a retrieval operation involving the entire drill string, this will have particular significance, as it will speed the operation up considerably compared with what has been possible up until today.

A further object of the invention has been to provide pipe handling equipment that is able to pick up a horizontally positioned pipe directly from the pipe rack on the main deck, bring it to a vertical position, and bring it into the drilling centre ready to be connected into a drill string with a minimum of manipulation. It is also becoming more of a requirement that everything is to be handled by use of remotely controlled mechanical equipment.

It is a further object still of the invention to provide pipe handling equipment that is able to handle piping goods of varying lengths, i.e. single pipes and stands, weights and nature without any significant modifications of the equipment. Further, it will not be necessary to have a finger board in the derrick and intermediate storage in the drill floor.

It is also an object of the present invention to enable the centre of gravity to be lowered and the wind catchment area to be reduced for a floating installation, while retaining efficient pipe handling.

Moreover, the present invention aims to improve the utilisation of the available space and/or reduce the size of the drill floor, by reducing or eliminating the need for storage of pipes on the drill floor. According to the present invention, this is achieved by making the handling of pipes in the pipe rack, and to and from this, more efficient, and more particularly by a transport carriage including picking devices that are designed to pick up pipes lying substantially in the horizontal position at different levels in a pipe rack.

One embodiment of the invention also comprises a pipe storage device for horizontal storage of pipes.

In a further embodiment, the present invention also comprises pipe handling equipment adapted for automated pipe handling between an approximately horizontal position and an approximately vertical position in a derrick and vice versa.

BRIEF DESCRIPTION OF THE DRAWINGS

The invention will now be explained in greater detail through a preferred embodiment, by means of the accompanying drawings, in which:

FIG. 1 is a side view of a pipe storage device 1 and a pipe picking device 2. The whole pipe storage device 1 is shown in perspective in FIG. 5, and the whole pipe picking device 2 is shown in perspective in FIG. 4.

DETAILED DESCRIPTION OF THE PREFERRED EMBODIMENTS

Figure 1:
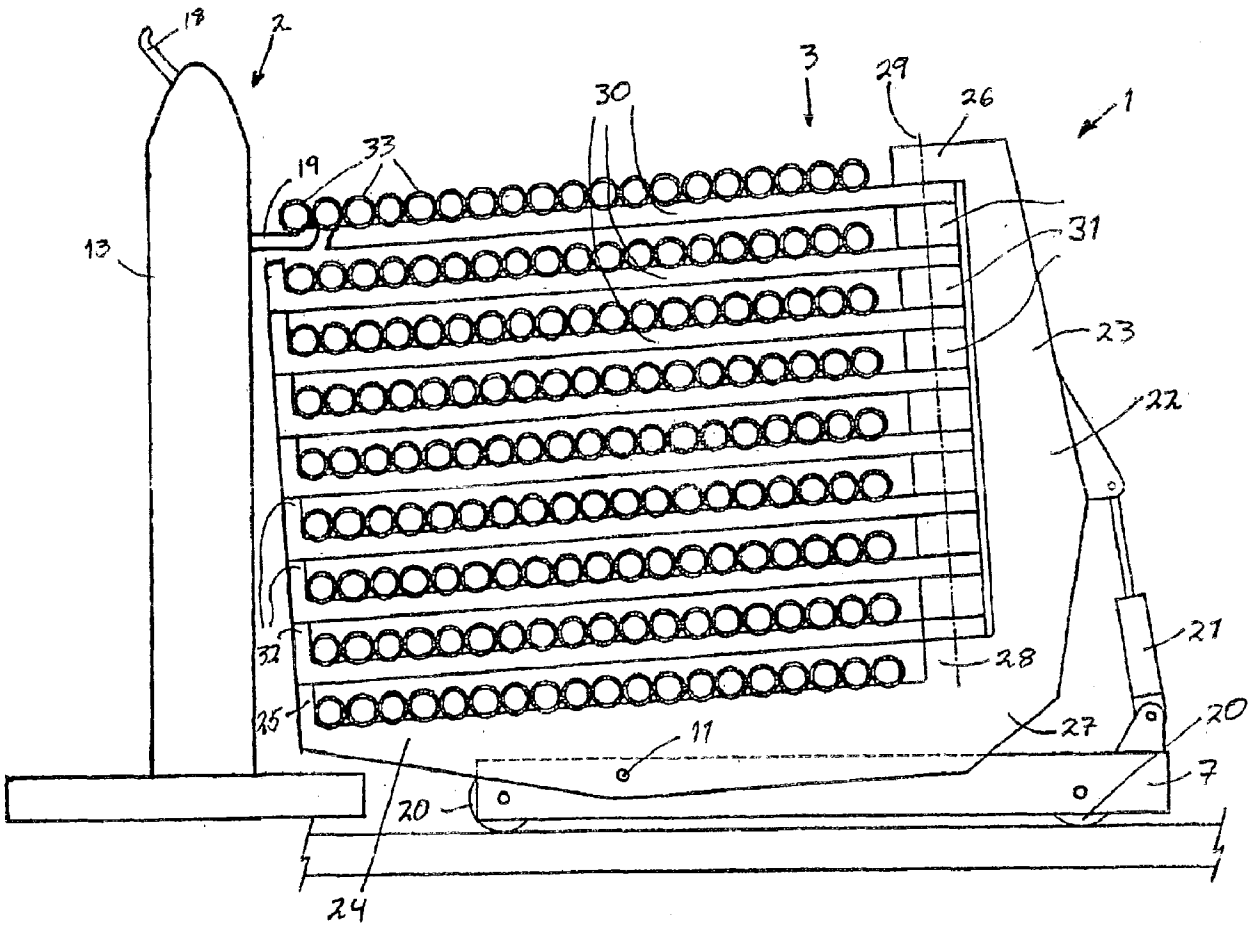
FIG. 1 shows a pipe storage device and a pipe picking device while picking out a pipe.

The pipe storage device 1 comprises two supporting blocks 3 and 4 that are interconnected via a base frame 5 including two transverse beams 6 and 7 and two longitudinal beams 8 and 9. Each supporting block 3 and 4 is arranged in a tilting manner about a mounting 10 and 11 respectively in the transverse beam 6 and 7 respectively. Means are provided (not shown) for synchronization of the tilting motion of the supporting blocks 3 and 4.

The pipe picking device 2 acts as a transport carriage for pipes to be transported between the storage device 1 and e.g. a lifting beam for raising pipes from a horizontal to a vertical position in order to bring this into the derrick, and includes picking columns 12 and 13, which are located on a base frame 14 that includes a longitudinal beam 15 and a transverse beam 16 and 17 at either end of the longitudinal beam 15. Each picking column is equipped with two picking arms 18 and 19. The picking columns 12 and 13 may advantageously be moved along the longitudinal beam 15 as shown by arrows 35 and 36, either synchronously towards and away from each other or independently of each other.

It is also possible to provide more than two picking columns on the pipe picker 2, in particular for handling long pipes or entire stands.

FIG. 1 shows one of the supporting blocks 4 of the pipe storage device. This is supported in a tiltable manner about the mounting 11 in the transverse beam 7. The transverse beam 7 is equipped with wheels 20. A tilt cylinder 21 is interposed between the transverse beam 7 and the supporting block 4.

The supporting block 4 consists of a generally L-shaped cradle 22 that comprises a generally vertical part 23 and a generally horizontal part, or bearer 24. A generally vertical stop 25 is provided by the free end of the horizontal part 24. The vertical part 23 has a generally horizontal projection 26 by its free end. A thickening 28 is formed at the corner 27 of the L-shaped cradle 22.

Between the projection 26 and the thickening 28 there is a bearing shaft 29. A plurality of supporting arms 30 are arranged in a rotatable manner about the shaft 29, which supporting arms extend in parallel with the horizontal part 24 of the cradle 22. A respective spacer 31 is mounted between the supporting arms 30 on the shaft 29. The supporting arms 30 have at their free ends a respective, generally vertical stop 32. The stops 32 are of such a height that each stop 32 rests on the stop 32 underneath, and the lowermost stop 32 rests on the stop 25.

Each arm 30 is designed to support a plurality of pipes 33. When the supporting blocks 3 and 4 are tilted to the position shown in FIG. 1, the pipes 33 roll against the stops 25 and 32 abut these. FIG. 1 shows a picking column 13 for the picker 2. This has been run up against the storage device 1, so that a picking arm 19 is positioned immediately underneath the uppermost and nearest pipe 33.

The pipe storage device 1 may if desired comprise more than two supporting blocks, particularly if long pipes or entire stands are to be stored.

Figure 3:
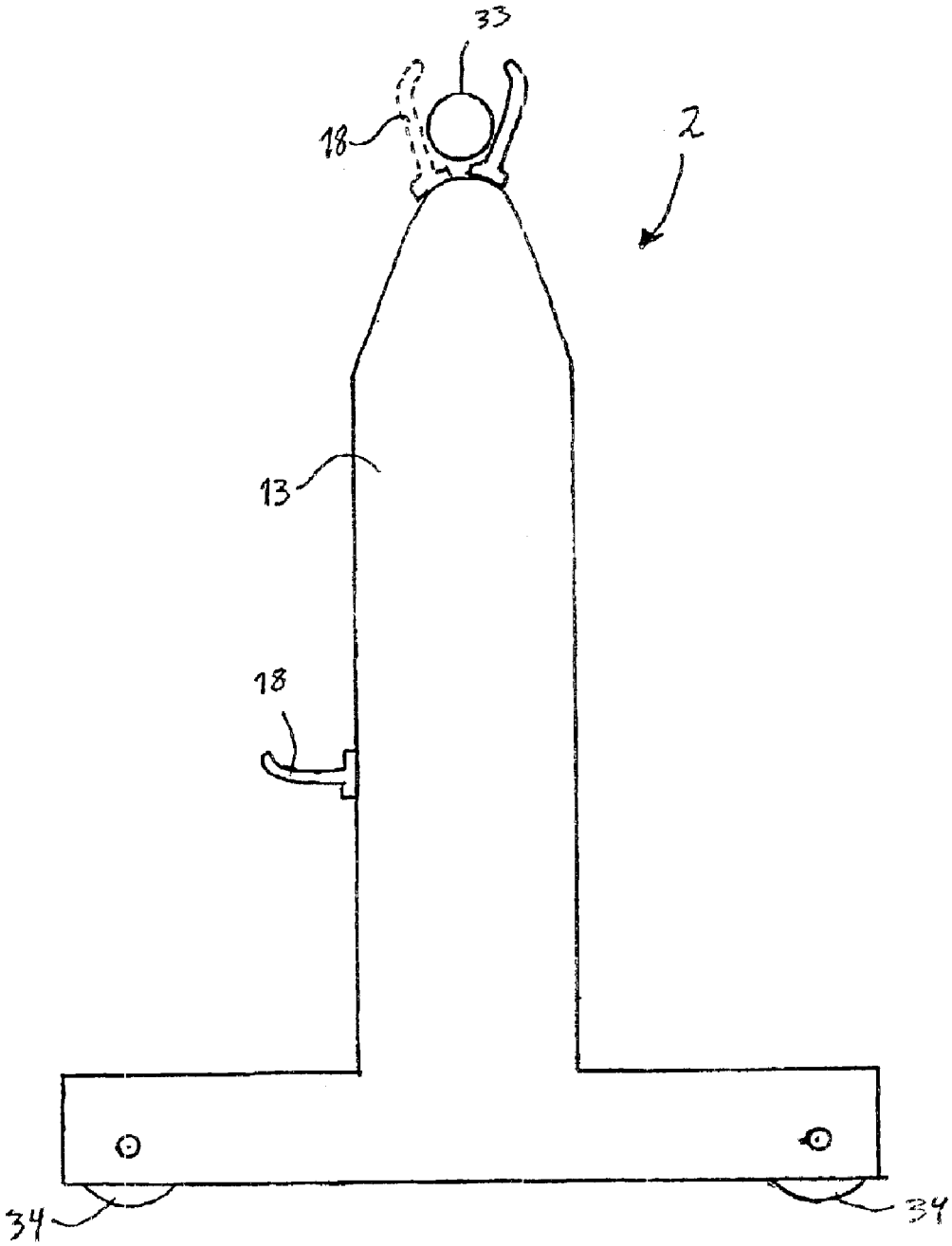
FIG. 3 shows a pipe device holding a pipe.
Figure 4:
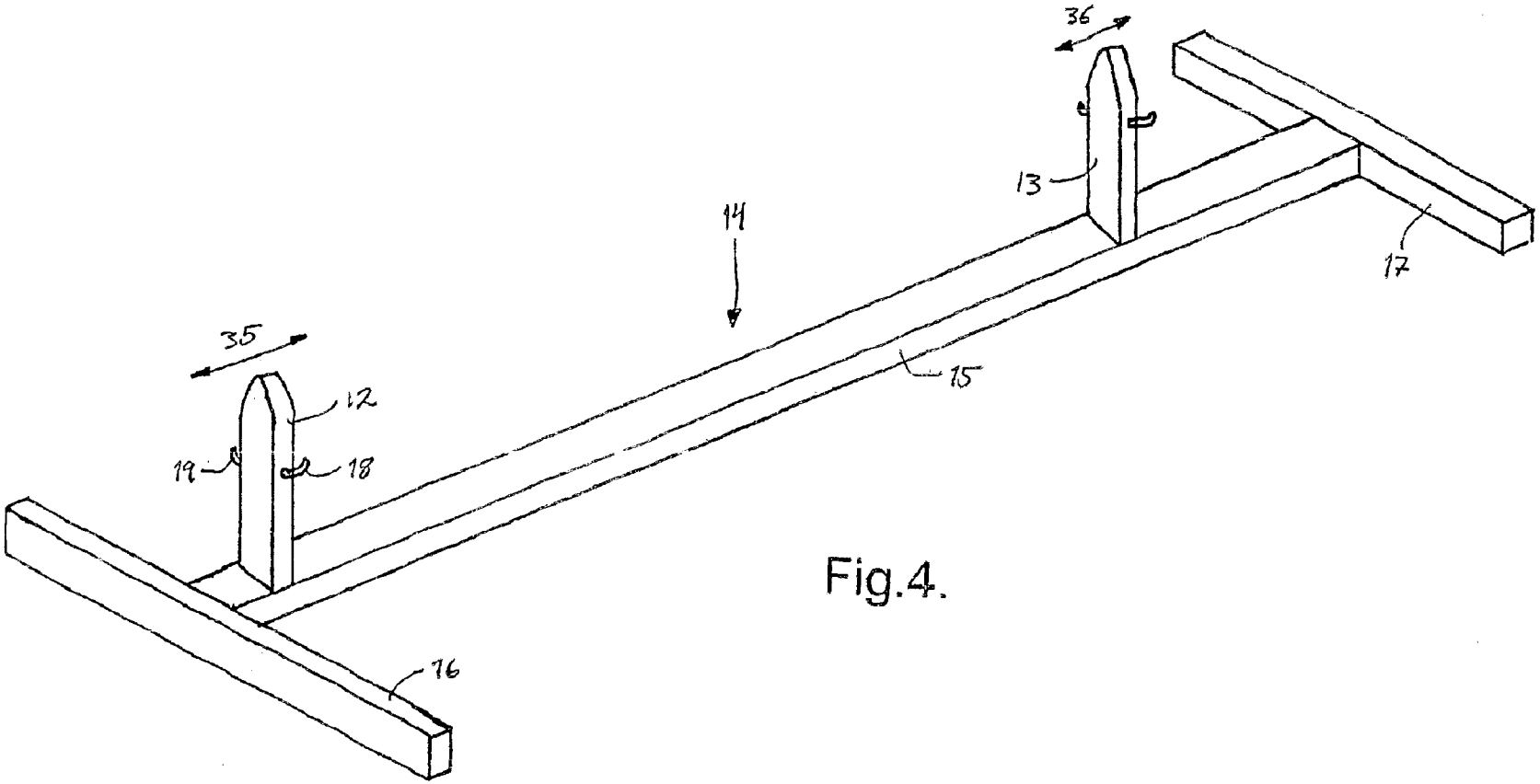
FIG. 4 is a perspective drawing of the pipe picking device of FIG. 3.

FIG. 3 shows the picking column 13 with the picking arms 18 and 19. The picking arms 18 and 19 may (as will be described in greater detail below) be run up and down along the side of the picking column 13, so that e.g. the picking arm 18 may be brought from the position shown in solid lines to the position shown in broken lines.

In FIG. 1, the picking arm 19 is ready to lift a pipe 33 and bring this up to the position shown in FIG. 3, in which the pipe is held between the picking arms 18 and 19 at the top of the picking column 13. It must be emphasised that the same movement is being performed at the other picking column 12, synchronously with the movement at picking column 13, although this is not shown in the figures. In this manner, the whole pipe is lifted in parallel from a position of the supporting blocks 3 and 4 to a position at the top of the picking columns 12 and 13.

Figure 2:
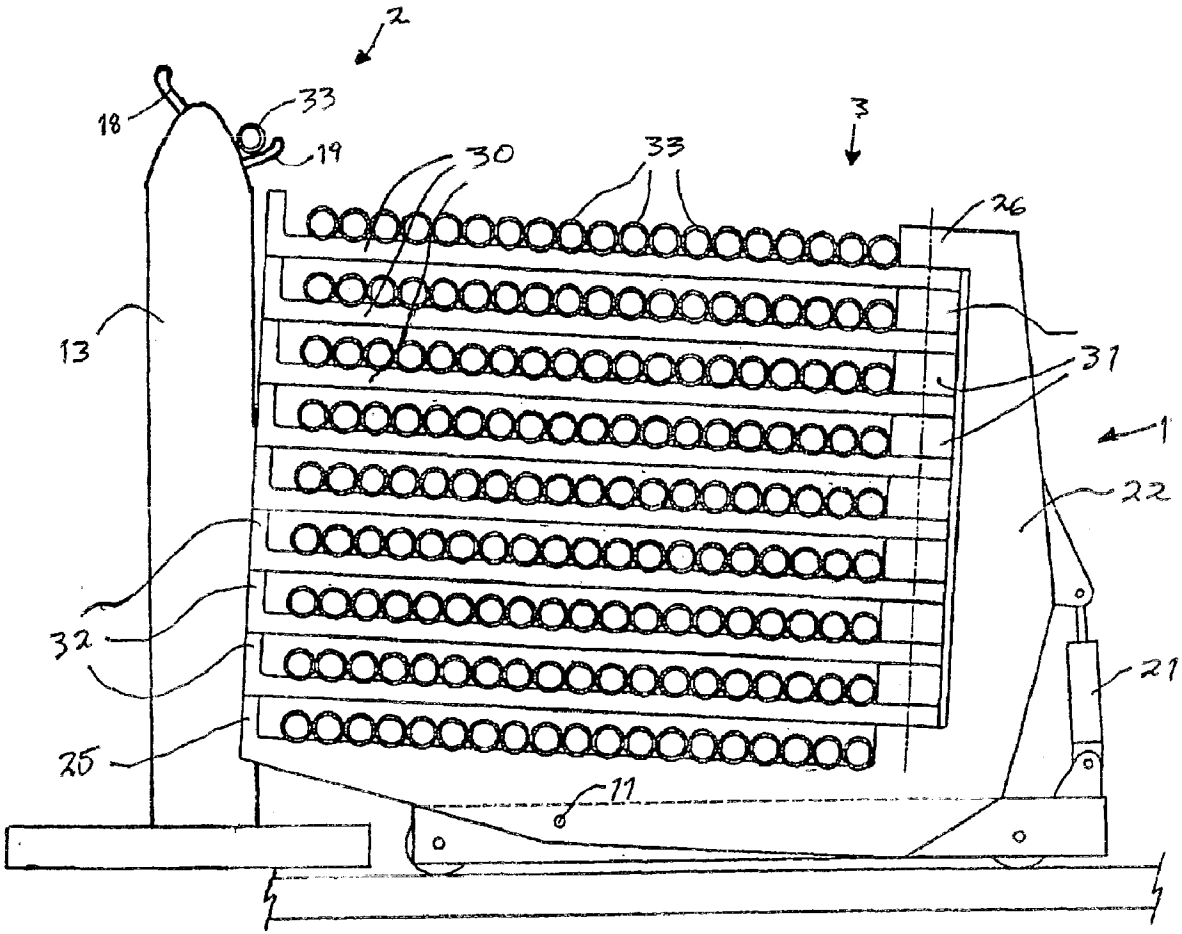
FIG. 2 shows the devices of FIG. 1 while replacing a pipe.

FIG. 2 shows the supporting block 3, however here it has been tipped backwards so as to make the pipes 33 abut the spacers 31 and the projection 26. The pipe picker 2 is now ready to place a pipe 33 into the storage device 1, by placing this on the supporting arm 30 behind the stop 32.

The base frame 15 of the pipe picker 2 is also equipped with wheels 34 (see FIG. 3) to allow the pipe picker 2 to run towards and away from the storage device 1. It is preferable that the pipe picker 2 also be able to run along the longitudinal axis of the pipe 33 in order to arrive at an appropriate position for delivery of a pipe to or receipt of a pipe from e.g. a lifting device designed to lift the pipe to a vertical position in order to bring this into the derrick.

Figure 5:
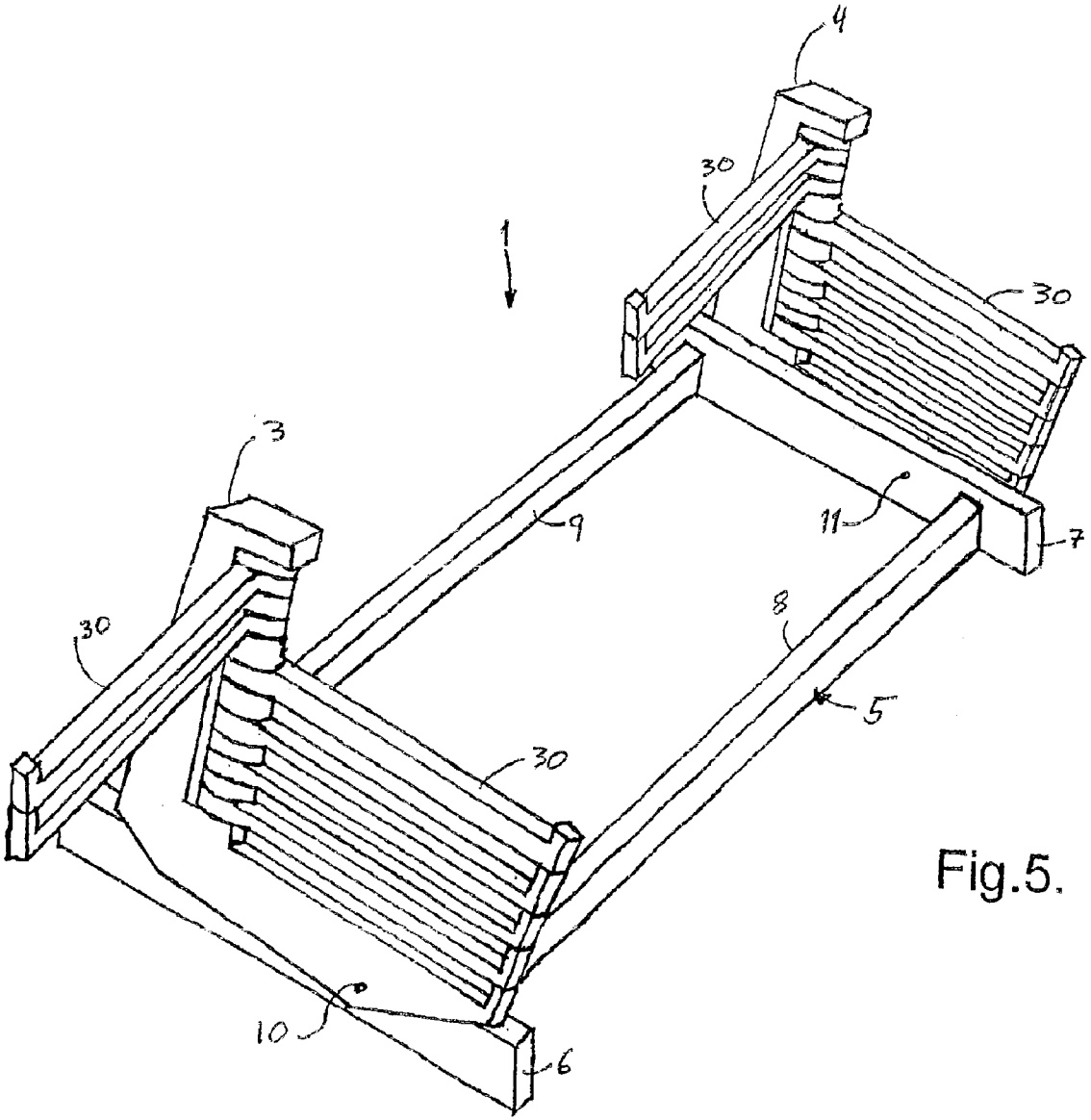
FIG. 5 is a perspective drawing of the pipe storage device of FIG. 1.

As shown in FIG. 5, the supporting arms 30 are rotatably supported in the shaft 29, so as to allow the arms 30 to be swung to the side. When all the pipes 33 have been removed from one arm 30, this is swung to the side so as to allow access to the pipes 33 lying on an underlying arm 30. Conversely, when an arm 30 has been fully loaded with pipes 33, the arm 30 above is swung back to a position over the fully loaded arm so as to allow pipes to be loaded onto the arm above. One arm in the supporting block 3 and a swivelling operation is preferably carried out by means of an actuator and remote control.

Figure 6:
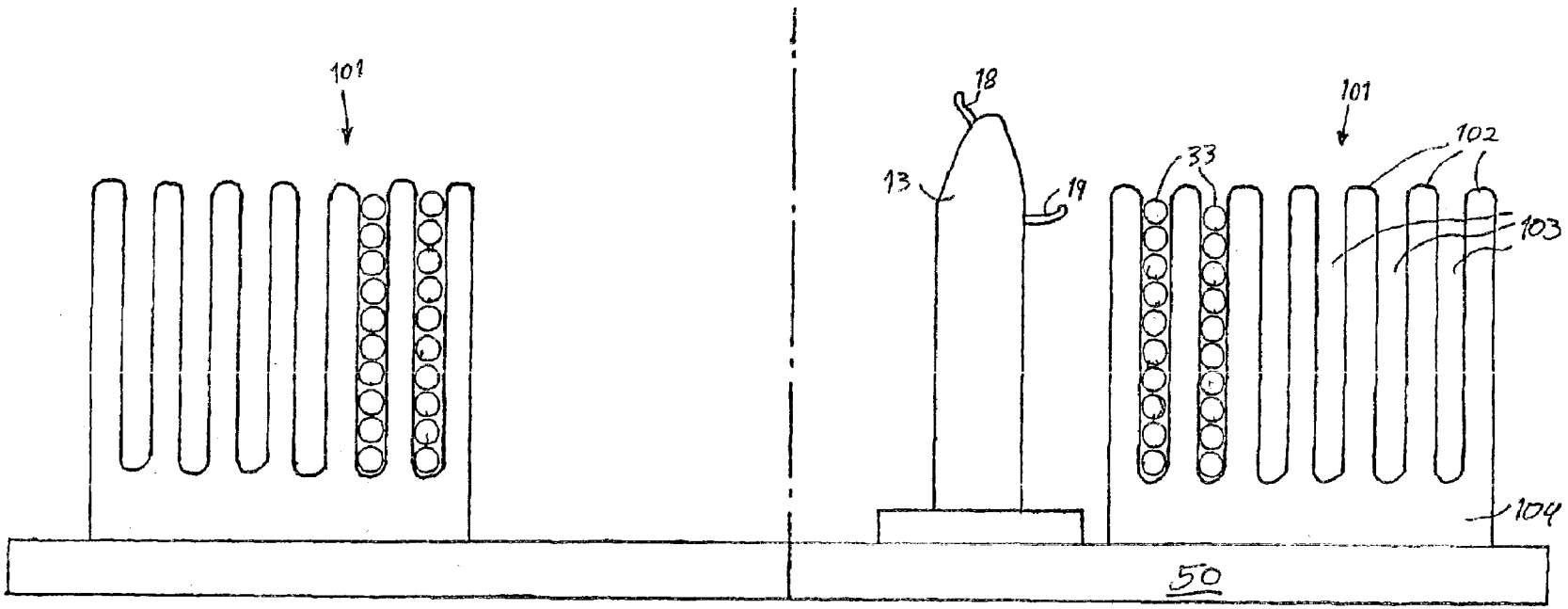
FIG. 6 shows a pipe picking device together with a pipe storage device.

FIG. 6 shows an alternative embodiment of a storage device according to the present invention. The storage device 101 comprises a plurality of generally vertical fingers 102 that between them define a storage space 103 for pipes 33. The fingers 102 are connected to a bearer 104 by their lower ends, which bearer is located on the piping deck 50.

The pipes 33 are designed to be stored on top of each other, and the bottom pipe rests against the bearer 104. The distance between the fingers 102 is slightly greater than the outer diameter of the pipes 33.

FIG. 6 shows two storage devices 101 and a pipe picker 2 that is principally of the same design as the pipe picker mentioned above.

Figure 7:
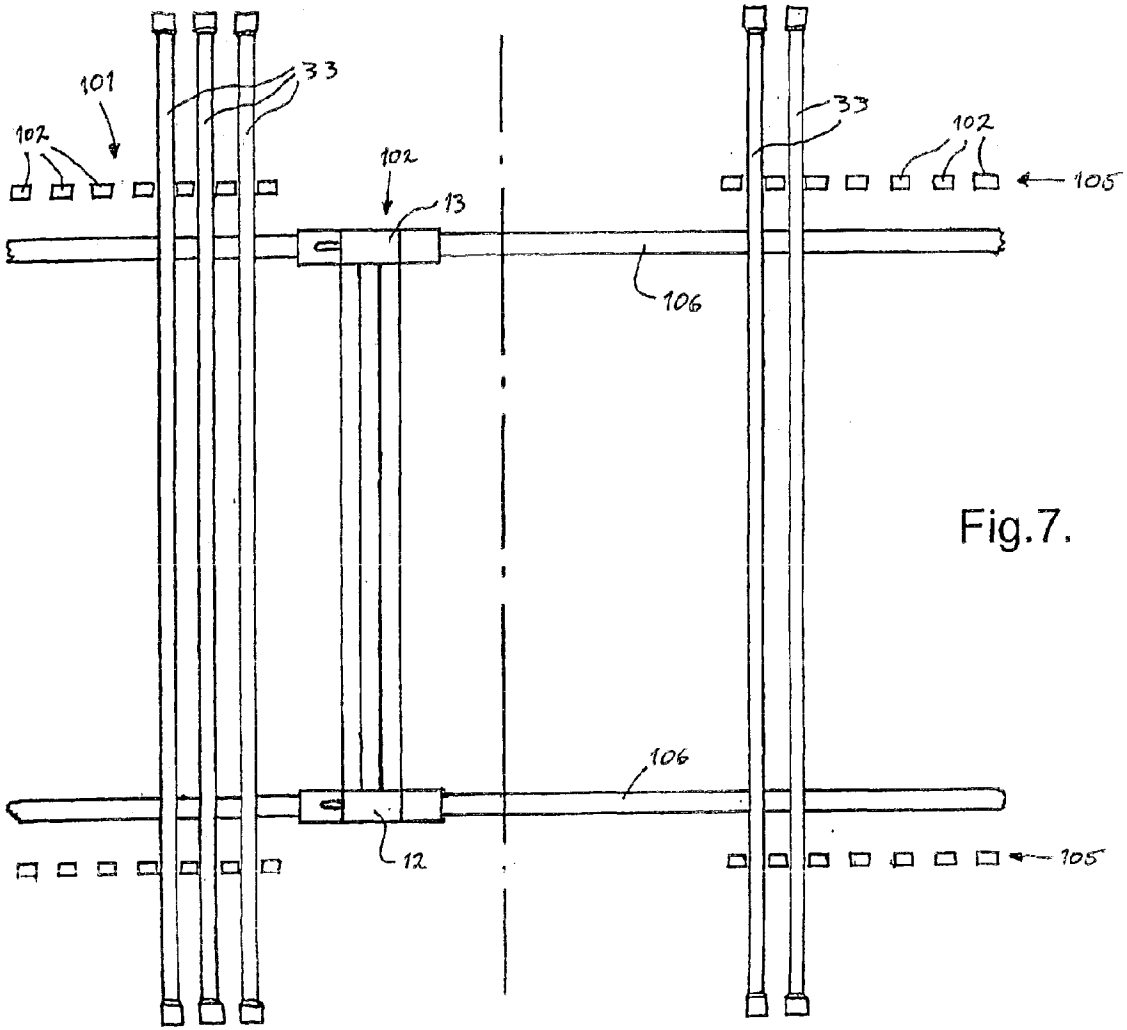
FIG. 7 shows a top view of the pipe storage device and the pipe picking device of FIG. 6.

FIG. 7 is a top view of the storage device 101 and the pipe picker 2. Here, each pipe rack 101 can be seen to include two supporting blocks 105, each of which is equipped with a number of vertical fingers 102. The distance between the two picking columns 12 and 13 of the pipe picker is set so as to allow the whole pipe picker 2 to pass between the supporting blocks 105 of the same storage device 101.

On the piping deck 50 are provided rails 106 along which the pipe picker 2 can move in order to collect pipes from one or the other of the storage devices 101, or if required replace pipes in the storage devices 101.

When the pipe picker 2 retrieves pipes from the storage devices 101, it will first retrieve that pipe 33 which is located at the top in the nearest storage space 103. When all the pipes have been retrieved from the nearest space 103, the pipe picker 2 proceeds to retrieve pipes from the next space 103, starting with the top pipe 33 in this space.

Figure 8:
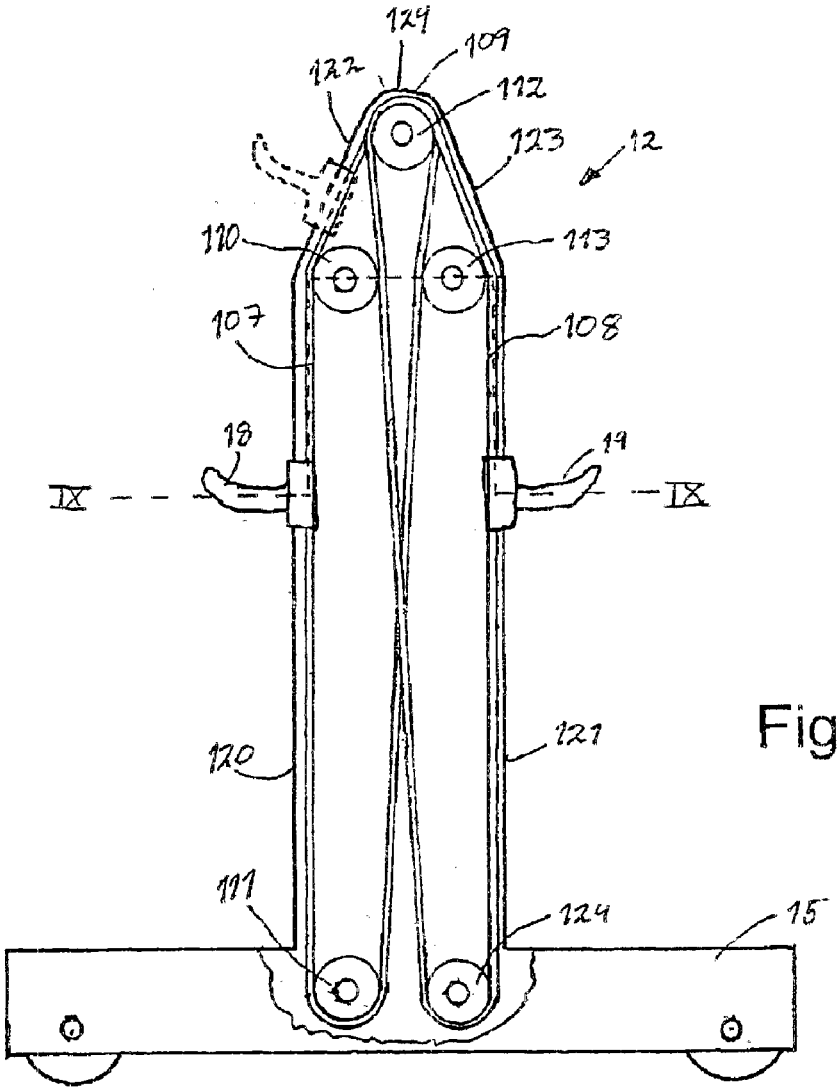
FIG. 8 is a sectional side view of a pipe picking device.
Figure 9:
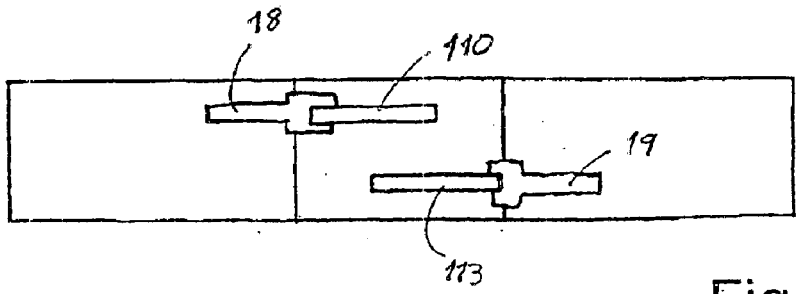
FIG. 9 is a sectional top view of a pipe picking device.

FIGS. 8 and 9 show in greater detail how the picking arms are manipulated. One of the picking columns 12 is shown partly sectioned. The picking column is formed as a generally vertical column comprising straight side walls 120 and 121 that extend vertically from the base frame 15 and inclined walls 122 and 123 that are angled towards each other from respective side walls 120 and 121 and are connected via a generally arched top wall 124.

The picking arms 18 and 19 are connected to separate continuous chains 107 and 108. The chain 107 extends over an upper end wheel 109 (hidden in FIG. 8) at the top 124 of the picking column 12, an intermediate wheel 110 at the point where the inclined wall 122 and the wall 120 meet and a lower end wheel 111 by the base frame 15. Likewise, the continuous chain 108 extends over an upper end wheel 112, which in FIG. 8 is located outside of the end wheel 19, an intermediate wheel 113 located at the point where the inclined wall 123 meets the wall 121, and a lower end wheel 124 by the base frame 15.

FIG. 9 is a sectional top view of the picking column 12, taken along the line IX. Here, it can be seen that the intermediate wheels 110 and 113 and the picking arms 18 and 19 are staggered in the sideways direction. The picking arms 18 and 19 can thereby be moved independently of each other. In FIG. 8, the solid line shows the picking arm 18 in one possible position, while the broken lines show it in another possible position. The arms 18 and 19 may independently of each other be moved from a position by the base frame 15 to a position by the top wall 124. This distance is at least equivalent to the relevant height interval within which the pipes in the pipe rack are stored. The walls 120, 121, 122, 123 and 124 are provided with through grooves 130 (see FIG. 10) through which the picking arms 18 and 19 extend, and along which they move.

Figure 10:
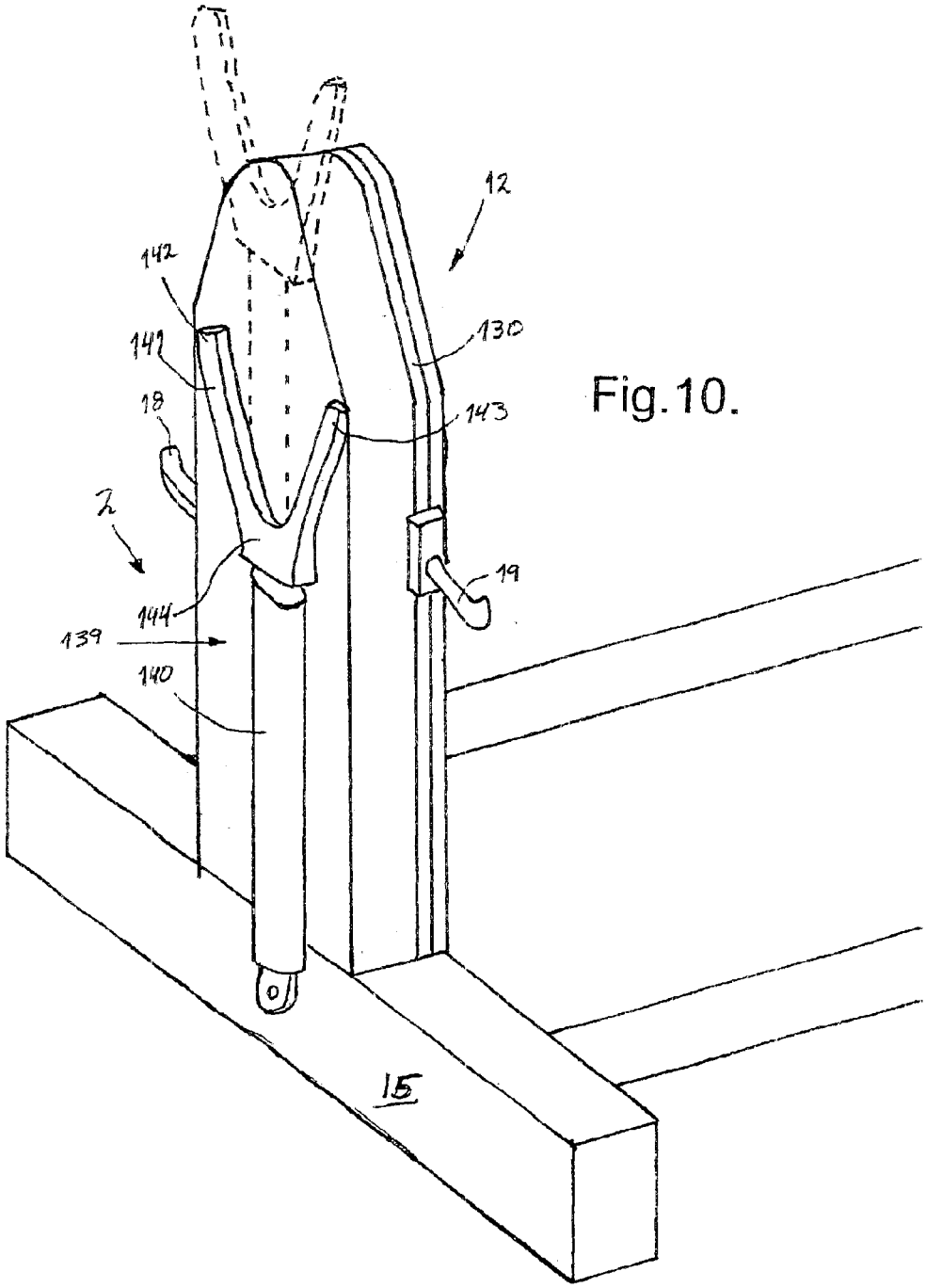
FIG. 10 shows an alternative embodiment of the a pipe picking device.

FIG. 10 shows an embodiment of the pipe picer 2 that includes a supplementary function. This supplementary function is represented by a pipe lifter 139 that in general comprises an actuator 140, e.g. a hydraulic cylinder as shown. One end of the cylinder 140 is connected to the frame 15, and the other end is connected to a generally V-shaped fork 141 including two legs 142 and 143 interconnected via a base 144. The fork is shown in its lower position by means of solid lines, and in its upper position by means of broken lines.

The pipe lifter 139 is used to hold large diameter pipes, e.g. casing pipes that are either too large to be held by the picking arms and/or are not designed to be stored in the storage device 1 or 101. In these cases, the pipe picker 2 is used to transport pipes between e.g. a crane and the derrick. In this manner, all types of piping may be brought to the same position as that of the pipes that are stored in the pipe storage device 1 or 101, so that further pipe handling equipment (for example as described below) can handle these in an expedient manner.

Figure 11:
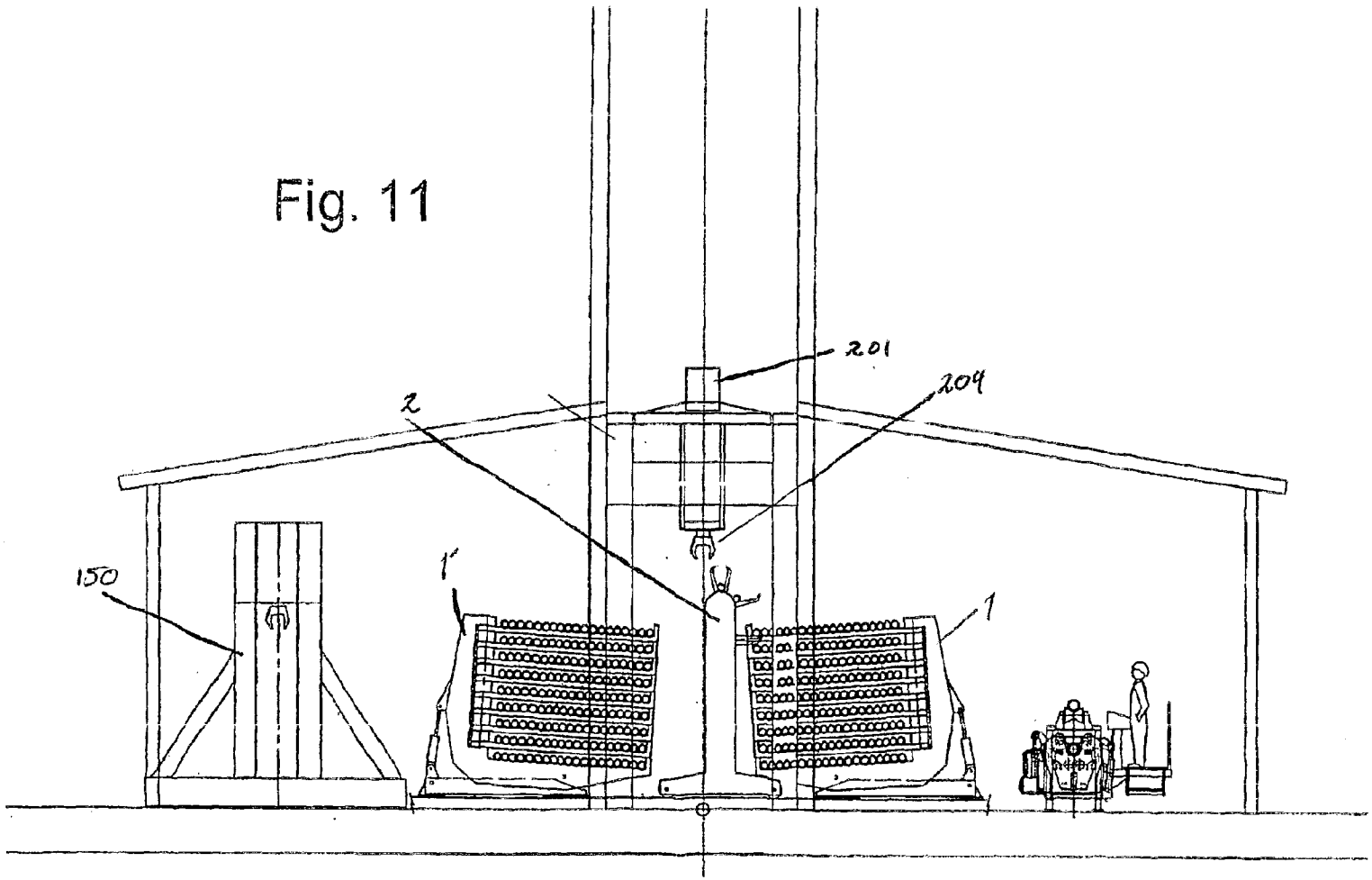
FIG. 11 shows a pipe picking device and two pipe storage devices co-operating with a pipe erecting device.

FIG. 11 shows how the pipe storage device 1 and the pipe picker 2 feed a pipe erecting device 201 such as is described in greater detail below, with pipes or stands 33. Here, two pipe storage devices 1 and 1' are positioned on either side of a pipe picker 2. The pipe picker 2 retrieves a pipe from one of the pipe storage devices 1 or 1' and transports it up to the pipe erecting device 201. The pipe erecting device 201 may be located immediately above the pipe picker 2 or at a distance away from this, across the plane of the paper. Grappler claws 204 on the pipe erecting device 201 are lowered and grip the pipe or the stand 33, lifting this up. The pipe picker 2 may also receive pipes from the pipe erecting device 201 in order to put these back in the pipe storage devices 1 and 1'. In FIG. 11, there is also shown a crane 150 that may be used to bring other equipment in underneath the pipe erecting device 201.

Figure 12:
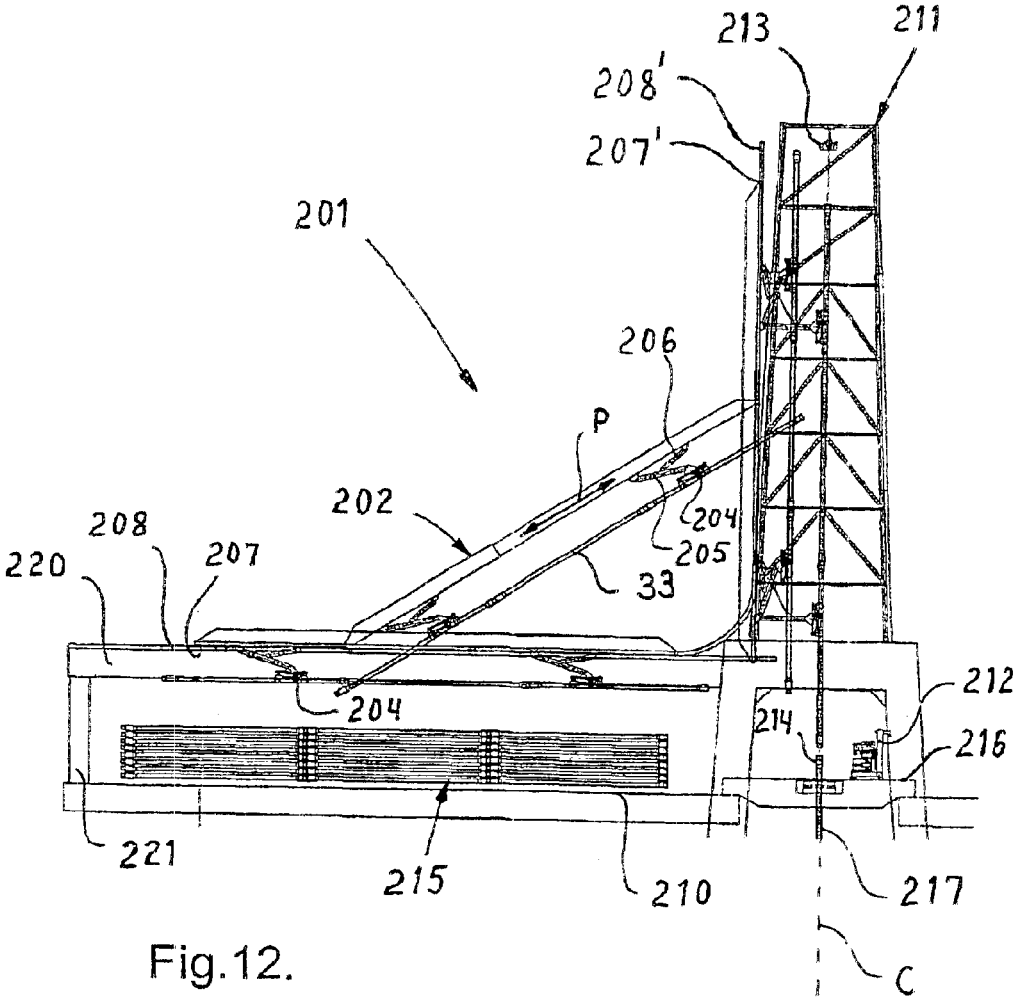
FIG. 12 is a side view of a pipe erecting device according to FIG. 11 handling a drill stand.

Reference is now made to FIG. 12 for a more detailed description of the pipe erecting device 201, which is located on a drilling rig (not shown). The pipe picker is not shown in FIG. 12–14 either. The drilling rig includes a main deck 210 that comprises a pipe storage device 215 having a large number of stands 33 lying in the horizontal position, which stands are in turn comprised of three single pipes. A derrick 211 projects vertically at one end of the main deck 210. A traditional top mounted drilling machine (not shown) operates along drilling centre C in the derrick 211. An elevator 213 suspended from the drilling machine can handle a vertically upright stand 33 in the derrick 211, and can lift the stand 33 up and down along drilling centre C. A spinning and torque tong 212 is located at a drill floor 216 near drilling centre C, and may be moved into and out of drilling centre C. The spinning and torque tong 212 is used to spin in and tighten up the correct torque in the pipe joints 214 between the stands 33, as well as to release and spin the pipe joints 214 out again.

The actual pipe erecting device 201 comprises an elongated boom 202 shown in three different transport positions on the rig. The boom 202 has two grappler claws 204 associated with it, which are able to move in towards a stand 33, grip it and pick it up from the pipe storage device 215 and retain the stand 33 during the subsequent transport. Each grappler claw 204 is placed at the end of an arm 205 that may be actuated into manipulation of the grappler claw 204 away from and in towards the boom 202. Each arm 205 is actuated by an actuating cylinder 206, one end of which is connected in an articulated manner to the boom 202, and the other end of which is connected in an articulated manner to the arm 205.

The boom 202 is further arranged telescopically along its longitudinal axis, as indicated by arrow P. This means that the boom 202 can be shortened when piping goods of a shorter length is to be handled. In the figure, this is indicated by one half of the boom 202 having a slightly smaller cross-sectional dimension than the other half of the boom 202. One half may be pushed into and guided in the other half, and they may be interlocked at the desired length. The displacement can be manual, by means of rack mechanisms or by means of actuating cylinders acting between the two halves.

In one end portion of the boom 202 guide means have been provided in the form of wheels 207 running in corresponding guides in the form of guide rails 208 attached to the top of two horizontal and parallel girders 220, which at one end are attached to the derrick structure and at the other end are attached to supports 221 located on the main deck 210. The guide rails 208 must extend far enough towards the drilling centre C to allow the boom 202 to be brought into a parallel position with the drilling centre C. At the other end portion of the boom 202 are also provided wheels 207' that run in guide rails 208' placed essentially vertically along the derrick 211. At the lower end, the vertical guide rails 208' deflect out onto the girders 220, and the last portion of the guide rails 208' run essentially horizontally out onto the girders 220 for a short distance.

In order to describe a pipe handling operation using the pipe erecting device 201, a start is made with an initial position in which the boom 202 lies horizontally on the girders 220. The arms 205 are manipulated so as to bring the grappler claws 204 down into the pipe rack 215 on the main deck 210. The grappler claws 204 grip a stand 33 and lilt it up against the boom 202. Then the boom 202 is run along the guide rails 208, 208' from its horizontal position and gradually to an increasingly vertical position until the boom 202 ends up in an essentially vertical position along the derrick 211. Throughout the operation, the grappler claws 204 that hold the stand 33 are brought up against the boom 200.

When the boom 202 is in its final, vertical position, the arms 205 are manipulated to bring the grappler claws 204, still holding the stand 33, away from the boom 202, and place the stand 33 in the drilling centre C. The drilling machine with the elevator 213 is run down, and the elevator 213 is arranged supportingly around the upper pipe joint. The grappler claws 204 loosen their grip on the stand 33, and the arms 205 are activated to withdraw the grappler claws 204 in towards the boom 202. The boom 202 may now be run back down to the pipe rack 215 in order to retrieve another stand 33 and repeat the above described operation.

The stand 33 now depends from the elevator 213, and the stand 33 is lowered towards a vertical pipe string 217 located below, called a "stick up". Normally, the string 217 includes a pipe box at the top, and the stand 33 includes a pin end at the bottom. When the pin end has been inserted into the pipe box, the spinning and torque tong 212 is run in against the pipe joint. The spinning tong first performs a spinning operation to screw the pin into the pipe box. Then the pipe joint is tightened to the correct make-up torque using the torque tong.

It must be appreciated that the boom 202 may be run completely independently of what is in progress in drilling centre C. Thus the end projection of the boom 202 and the placement of the guide rails 208, 208' are calculated so as not to bring the stand 33 into or into conflict with drilling centre C while the boom 202 is being run between the pipe rack 215 and the derrick 211, i.e. between the horizontal and the vertical position, and vice versa.

Figure 13:
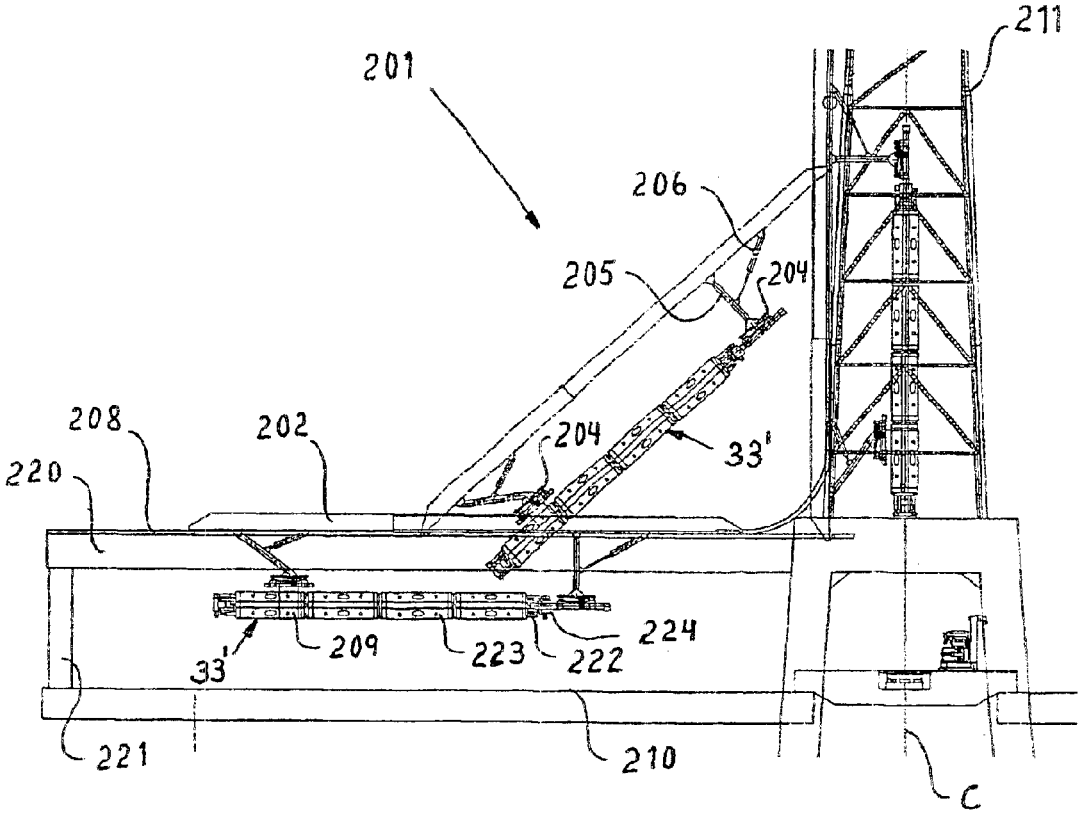
FIG. 13 shows the pipe erecting device of FIG. 12 handling a riser.

FIG. 13 shows the same pipe handling equipment 201 as that shown in FIG. 12, and equal components have been given the same reference numbers. It is the piping goods to be handled that differs from FIG. 12. The piping goods is now a riser or production tubing 33'. The Figure will also be representative of the handling of casing. The riser 33' has considerable dimensions, and has smaller pipes 222 and buoyancy elements 223 clamped onto the outside. The rear grappler claw 204 can grip a sling tool 209 that holds and guides the riser 33'. The forward grappler claw 204 can hold a tool 224, the end of which is run into the riser 33' and braced inside the pipe 33' by means of clamps. Here, a situation is shown in which the arms 205 that carry the grappler claws 204 are kept permanently extended from the boom 202 while this is run up and into the derrick 211, thereby inserting the riser 33', directly into drilling centre C.

Figure 14:
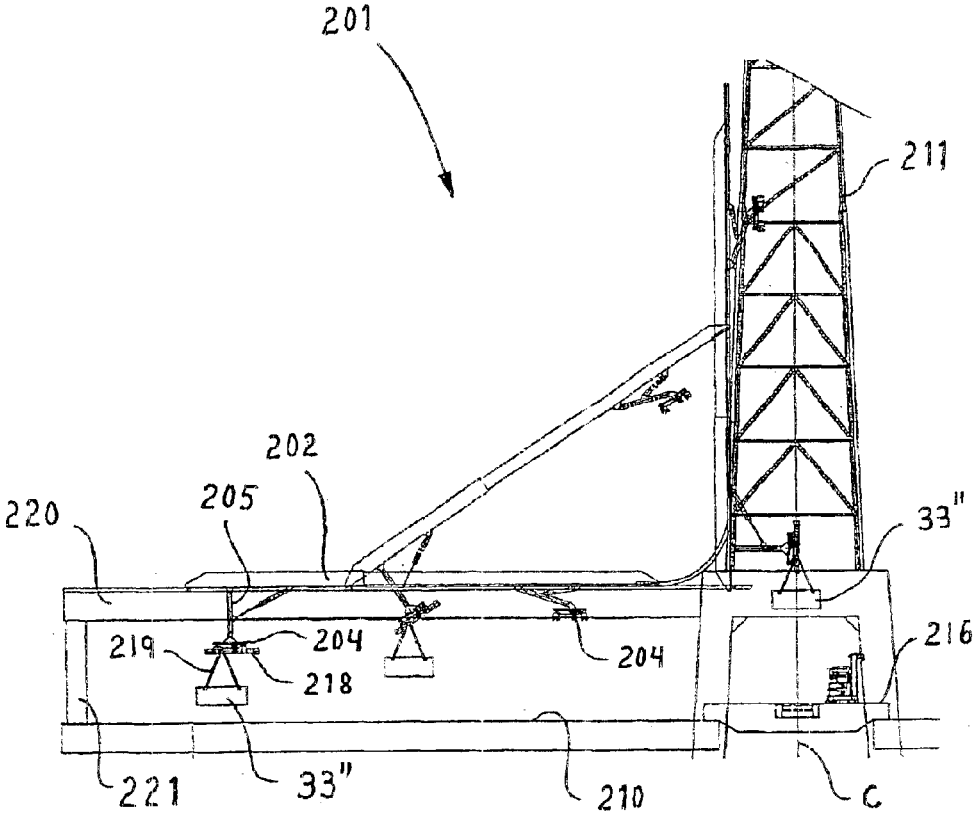
FIG. 14 shows the pipe erecting device of FIG. 12 handling single objects.

FIG. 14 also shows the same pipe handling equipment 201 as in FIGS. 12 and 13. Here however, the object being handled is not piping goods, but an item 33" being brought from the piping rack 215 on the main deck 210, slightly up and into the derrick 211, and down onto the drill floor 216, but close to drilling centre C. The item 33", e.g. a tool, is held by the rear grappler claw 204 by means of a piece of pipe 218 that faces the direction of travel and a sling that holds a basket or the item 33". The arm 205 is kept in an extended position, and when the boom 202 is vertical, the basket is brought directly into drilling centre C. Then the elevator 213 can be brought down to grip the pipe joint, the grappler claw 204 can release its hold, and the basket is lowered onto the drill floor 216.

For the pipe erecting device 201 according to the invention, it is clear to see how the drilling machine and the elevator 213 handle single items vertically, while the boom 202 and the grappler claws 204 handle items from the vertical position and out onto the drill floor to a horizontal position and vice versa.

FIGS. 12–14 also show that the drill floor 216 and the main or piping deck 210 can be disposed at the same level. This is an advantage that may be derived by use of the present invention as a result of the pipes being stored horizontally and thereby not is requiring much space in the height direction, and as a result of the efficient pipe handling achieved by the devices according to the invention described above.

Figure 15:
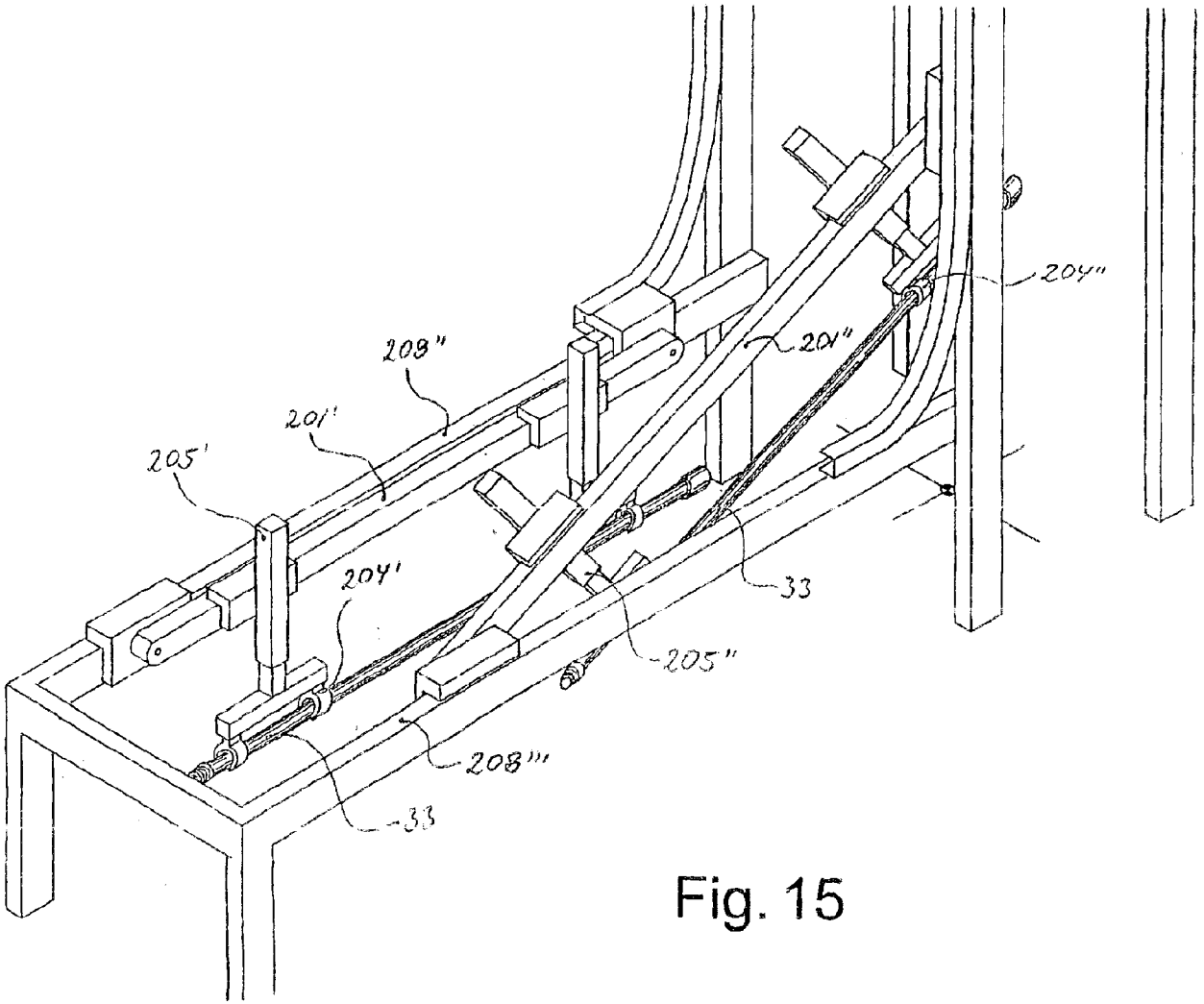
FIG. 15 shows an alternative embodiment of a pipe erecting device, in which two pipe erecting devices work independently and in parallel.

FIG. 15 shows an alternative embodiment to that shown in FIGS. 12–14. Here, two pipe erecting devices 201' and 201" are arranged in separate guide rails 208' and 208". The guide rails 208' and 208" have been placed at a distance from and on either side of a line L that runs horizontally through drilling centre C.

Each of the rails 208" and 208'" and each of the pipe erecting devices 201' and 201" may in principle be designed in the same manner as the pipe erecting device 201 of FIGS. 12–14. It may however be practical for the arms 205' and 205" with the grappler claws 204' and 204" to be rotatable about the longitudinal axis of the boom 202' and 202" respectively. In this manner, the pipes 33 may be brought in directly over drilling centre C. For the remainder, the pipe erecting devices 201' and 201" are designed in the same manner as the pipe erecting device 202 of FIGS. 12–14.

By using two pipe erecting devices, the capacity may be doubled.

Figure 16:
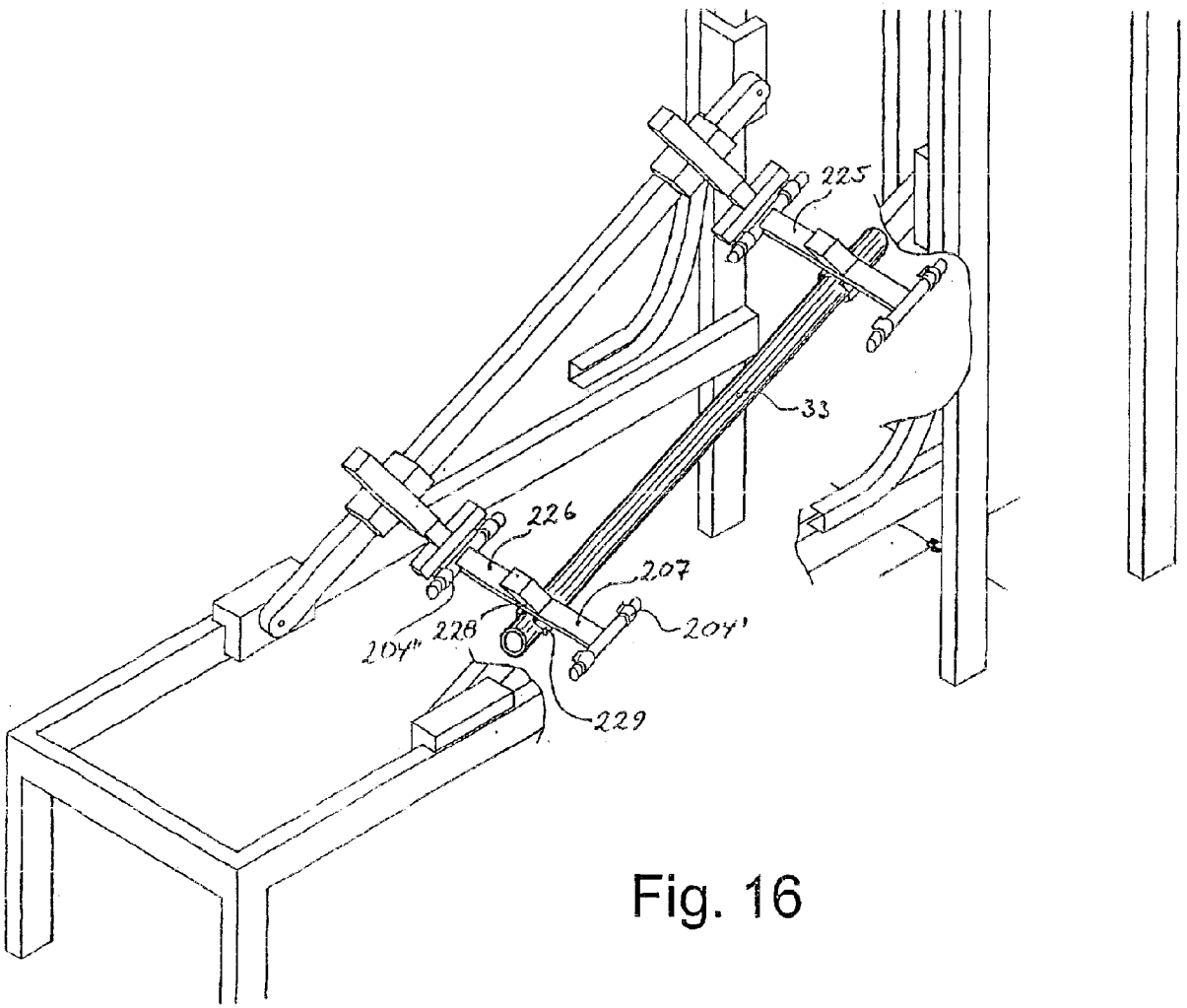
FIG. 16 shows the pipe erecting devices of FIG. 15 co-operating while erecting a heavy pipe.

FIG. 16 illustrates a case in which the pipe erecting devices 201' and 201" co-operate in lifting a very heavy pipe 33', e.g. a drill collar. This pipe may be transported up to the pipe erecting devices by use of the pipe picker 2 and the pipe lifter 139 shown in FIG. 10, by use of the crane 150 or in another expedient manner. In this case, the pipe erecting devices 201' and 201" are connected to each other via two yokes 225 and 226. The yokes 225 and 226 are held by the claws 204' and 204", so that each yoke forms a bridge between the booms 202' and 202". Each yoke comprises a beam 227, an arm 228 placed approximately at the middle of the beam 227, and a claw 229 placed at the outer end of the arm 228. The arm 228 may be longitudinally adjustable.

Further modifications of the invention, beyond what is mentioned above, may be envisaged. This includes using e.g. a crane to replace pipes in the pipe rack instead of using the pipe picker. The pipe picker may be designed so as to be able to handle several pipes at once. It is also possible to imagine each pipe picking column being equipped with more than two picking arms, so that the pipe picker may handle several pipes separately.

It is also conceivable for the pipe picker to be equipped with only one picking arm on each picking column, and, if desired, for a fixed back stop to be arranged by the top of the picking column instead of the other arm. This will be appropriate if the pipe picker is to retrieve pipes from a rack on one side only.

Alternatively, it is also conceivable for both picking arms to be brought down on the same side of the picking column, so that a pipe may also be held between these while being lifted.

It is also conceivable that the picking arms on different picking columns may be adjustable to different levels, so as to enable the pipe picker to pick up and put down inclined pipes.

Any combination of the various types of pipe pickers and storage devices and/or mutual co-operation that are practical, also lie within the scope of the present invention, provided this falls within the following independent claims.

What is claimed is:

1. A device for handling pipes, comprising a transport capable of horizontal movement for transporting pipes between a pipe rack and a place of use, the transport comprising picking devices that are designed to pick up pipes lying substantially in the horizontal position at different levels in a pipe rack wherein the picking devices comprise at least two first picking arms that are placed at a horizontal distance from each other and are designed to move substantially vertically, and to lift at least one pipe out of the pipe rack in a substantially horizontal position and at least one back stop that is designed to hold the nine that is being lifted, the pipe being held against the back stop by the first picking arm and wherein the transport constitutes a carriage horizontally moveable towards and away from the pipe rack.

2. The device of claim 1, wherein the carriage is equipped with a pipe lifter that comprises a generally V-shaped fork and an actuator connected to the fork, which wherein the actuator is designed to move the fork essentially in the vertical direction.

3. The device of claim 1, further comprising a pipe storage device for co-operation with the transport carriage, wherein the pipe storage device comprises at least two supporting blocks for horizontal support of a plurality of pipes wherein each supporting block comprises a plurality of generally vertically oriented fingers, between which are defined storage spaces for storing pipes against each other in a generally vertical column.

4. The device of claim 3, further comprising storage spaces having a width that is slightly greater than the outer diameter of the pipes, so as to leave the pipes in each storage space lying on top of each other in a single stack.

5. The device of claim 1 further comprising a pipe erecting device for co-operation with the transport carriage wherein the pipe erecting device is designed to handle piping goods between an approximately horizontal position on a drilling rig and an approximately vertical position in a derrick and vice versa, which pipe erecting device includes an elongated boom with at least one associated grappler claw for gripping the piping goods, where the boom is provided with supporting guide means at each end, which run along guides on the drilling rig and in the derrick respectively and wherein the boom may be run between an approximately vertical position in the derrick and vice versa, and that each grappler claw is maneuverable arranged on a respective arm attached to the boom, where each arm when in action is capable of picking up a horizontally positioned pipe, run the boom while carrying the pipe up to a vertical stand-by position, and at an appropriate time activate each arm to bring the pipe from the vertical standby position in or by the derrick in towards a drill axis (C) for coupling to a piping string, and vice versa.

6. The device of claim 5, wherein the boom is telescopically arranged in the longitudinal direction in order to allow shortening or extension of the boom.

7. The device of claim 5 wherein each arm is connected with an actuating cylinder which upon actuation brings the grappler claw away from or in towards the boom.

8. The device of claim 5, wherein each arm is movably boom.

9. The device of claim 5, wherein the guide means are in the form of rollers and the guides are in the form of guide rails.

10. The device of claim 1, wherein the back stop is formed by a second picking arm designed to be moved vertically.

11. The device of claim 10, wherein the first picking arm is designed to move vertically on one side of an essentially vertically oriented picking column, and wherein the second picking arm is designed to move essentially vertically on the other side of the picking column.

12. The device of claim 11, wherein the picking arms are each connected to separate continuous chains, each of which is passed over at least an upper and a lower wheel, and wherein one chain and the associated wheels are staggered horizontally relative to the other chain and its associated wheels, so that the picking arms may be moved independently of each other.

13. The device of claim 1, further comprising a pipe storage device for co-operation with the transport carriage, wherein the pipe storage device comprises at least two supporting blocks for horizontal support of a plurality of pipes and wherein each supporting block comprises a plurality of supporting arms on which a plurality of pipes is arranged to be supported, and wherein the supporting arms are arranged rotably about an axis at one end of the supporting arm, so that the arms may be swung to one side in order to allow access to underlying pipes.

14. The device of claim 13, wherein each supporting arm at a free end thereof, rests on the free end of any underlying arm, and wherein the bottom arm rests on a bearer.

15. The device of claim 14, wherein a bearer forms part of a cradle to which the arms are connected, and wherein the cradle is designed to tilt about a mounting in a base frame, so that the pipes may optionally abut a stop by free outer ends of the arms for extraction of pipes, or stopper by inner ends of the arms for insertion of pipes.

16. The device of claim 1, further comprising two pipe erecting devices for co-operation with the transport carriage wherein each of the pipe erecting devices is designed to handle piping goods between an approximately horizontal position on a drilling rig and an approximately vertical position in a derrick and vice versa, which pipe erecting devices each include an elongated boom with at least one associated grappler claw for gripping the piping goods, where each end portion of the boom is provided with supporting guide means that run along guides on the drilling rig and the derrick respectively, and wherein the boom may be run between an approximately horizontal position on the drilling rig and an approximately vertical position in the derrick and vice versa.

17. The device of claim 16, wherein the two pipe erecting devices are designed to handle a long object together.

18. The device of claim 17, further comprising at least one yoke designed to be interposed between the two pipe erecting devices in order to carry the long object.

19. A device for handling pipes, comprising a transport capable of horizontal movement for transporting pipes between a pipe rack and a place of use, the transport comprising picking devices that are designed to pick up pipes lying substantially in the horizontal position at different levels in a pipe rack wherein the transport constitutes a carriage horizontally moveable towards and away from the pipe rack and a pipe erecting device for co-operation with the transport carriage wherein the pipe erecting device is designed to handle piping goods between an approximately horizontal position on a drilling rig and an approximately vertical position in a derrick and vice versa, which pipe erecting device includes an elongated boom with at least one associated grappler claw for gripping the piping goods, where the boom is provided with supporting guide means at each end, which run along guides on the drilling rig and in the derrick respectively and wherein the boom may be run between an approximately vertical position in the derrick and vice versa, and wherein each grappler claw is manoeuverably arranged on a respective arm attached to the boom, where each arm when in action is capable of picking up a horizontally positioned pipe, run the boom while carrying the pipe up to a vertical stand-by position, and at an appropriate time activate each arm to bring the pipe from the vertical standby position in or by the derrick in towards a drill axis (C) for coupling to a piping string, and vice versa.

20. A device for handling pipes, comprising a transport capable of horizontal movement for transporting pipes between a pipe rack and a place of use, the transport comprising picking devices that are designed to pick up pipes lying substantially in the horizontal position at different levels in a pipe rack wherein the transport constitutes a carriage horizontally moveable towards and away from the pipe rack wherein the carriage is equipped with a pipe lifter that comprises a generally V-shaped fork and an actuator connected to the fork, which wherein the actuator is designed to move the fork essentially in the vertical direction.

21. A device for handling pipes, comprising a transport capable of horizontal movement for transporting pipes between a pipe rack and a place of use, the transport comprising picking devices that are designed to pick up pipes lying substantially in the horizontal position at different levels in a pipe rack wherein the transport constitutes a carriage horizontally moveable towards and away from the pipe rack and a pipe storage device for co-operation with the transport carriage, wherein the pipe storage device comprises at least two supporting blocks for horizontal support of a plurality of pipes and wherein each supporting block comprises a plurality of supporting arms on which a plurality of pipes is arranged to be supported, and wherein the supporting arms are arranged rotably about an axis at one end of the supporting arm, so that the arms may being to one side in order to allow access to underlying pipes.

22. A device for handling pipes, comprising a transport capable of horizontal movement for transporting pipes between a pipe rack and a place of use, the transport comprising picking devices that are designed to pick up pipes lying substantially in the horizontal position at different levels in a pipe rack wherein the transport constitutes a carriage horizontally moveable towards and away from the pipe rack and two pipe erecting devices for co-operation with the transport carriage wherein each of the pipe erecting devices is designed to handle piping goods between an approximately horizontal position on a drilling rig and an approximately vertical position in a derrick and vice versa, which pipe erecting devices each include an elongated boom with at least one associated grappler claw for gripping the piping goods, where each end portion of the boom is provided with supporting guide means that run along guides on the drilling rig and the derrick respectively, and wherein the boom may be run between an approximately horizontal position on the drilling rig and an approximately vertical position in the derrick and vice versa.

* * * * *

UNITED STATES PATENT AND TRADEMARK OFFICE

CERTIFICATE OF CORRECTION

PATENT NO. : 6,860,694 B2
DATED : March 1, 2005
INVENTOR(S) : Slettedal

It is certified that error appears in the above-identified patent and that said Letters Patent is hereby corrected as shown below:

Column 9,
Line 43, delete “nine” and insert -- pipe --.

Column 10,
Line 10, delete “maneuverable” and insert -- maneuverably --.
Line 24, after “movably” insert -- attached to the --.

Column 11,
Lines 32-33, delete “manoeverably” and insert -- maneuverably --.

Column 12,
Line 22, delete “being” and insert -- be swung --.

Signed and Sealed this

Twenty-seventh Day of September, 2005

JON W. DUDAS
*Director of the United States Patent and Trademark Office*